US006283572B1

(12) United States Patent
Kumar et al.

(10) Patent No.: US 6,283,572 B1
(45) Date of Patent: Sep. 4, 2001

(54) DYNAMIC MULTI-PASS PRINT MODE CORRECTIONS TO COMPENSATE FOR MALFUNCTIONING INKJET NOZZLES

(75) Inventors: Shailendra Kumar, San Diego, CA (US); Javier Lagares; Gonzalo Gaston, both of Sant Cugat del Vallès (ES)

(73) Assignee: Hewlett-Packard Company

( * ) Notice: Subject to any disclaimer, the term of this patent is extended or adjusted under 35 U.S.C. 154(b) by 0 days.

(21) Appl. No.: 08/810,467

(22) Filed: Mar. 4, 1997

(51) Int. Cl.[7] ..... B41J 29/393
(52) U.S. Cl. ..... 347/19; 347/37
(58) Field of Search ..... 374/19, 37, 40, 374/41

(56) References Cited

U.S. PATENT DOCUMENTS 5,124,720 * 6/1992 Schantz ..... 347/19
5,319,389 6/1994 Ikeda et al. ..... 346/1.1

FOREIGN PATENT DOCUMENTS 0694396 1/1996 (EP) ..... B41J/2/07
WO9632263 10/1996 (WO) ..... B41J/2/04
WO9840222 9/1998 (WO) ..... B41J/29/387

* cited by examiner

*Primary Examiner*—Arthur T. Grimley
*Assistant Examiner*—Greg Moldafsky

(57) ABSTRACT

Described is a dynamic multi-pass print mode correction method which corrects for malfunctioning or inoperable ink ejection elements by substituting a fully functioning ink ejection element. The method comprises the steps of obtaining a printmask; identifying ink ejection elements which are malfunctioning; ascertaining potential replacement ink ejection elements from the printmask for the ejection elements which are malfunctioning; selecting replacement ink ejection elements from the potential replacement ink ejection elements; and modifying the printmask by removing the malfunctioning ink ejection elements from the printmask and replacing them with the selected replacement ink ejection elements.

21 Claims, 7 Drawing Sheets

DYNAMIC MULTI-PASS PRINT MODE CORRECTIONS TO COMPENSATE FOR MALFUNCTIONING INKJET NOZZLES

CROSS-REFERENCE TO RELATED APPLICATIONS

This application relates to the subject matter disclosed in U.S. patent application, Ser. No. 08/811412, filed concurrent herewith, OF PRINTHEAD NOZZLE FUNCTIONALITY BY OPTICAL SCANNING OF A TEST PATTERN"; and U.S. patent application, Ser. No. 08/810747, filed concurrent herewith, entitled "BIDIRECTIONAL COLOR PRINT-MODES WITH SEMISTAGGARED SWATHS TO MINIMIZE HUE SHIFT AND OTHER ARTIFACTS". The foregoing patent applications are herein incorporated by reference.

FIELD OF THE INVENTION

This invention relates to inkjet printers using multi-pass printmodes and, more particularly, to an inkjet printer which corrects for malfunctioning or inoperable ink ejection elements by substituting a fully functioning ink ejection element.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge times the distance between nozzle centers. After each such completed movement or swath the medium is moved forward the width of the swath, and the ink cartridge begins the next swath. By proper selection and timing of the signals, the desired print is obtained on the medium.

Color inkjet hardcopy devices commonly employ a plurality of print cartridges, usually either two or four, mounted in the printer carriage to produce a full spectrum of colors. In a printer with four cartridges, each print cartridge contains a different color ink, with the commonly used base colors being cyan, magenta, yellow, and black. In a printer with two cartridges, one cartridge usually contains black ink with the other cartridge being a tri-compartment cartridge containing the base color cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

For many applications, such as personal computer printers and fax machines, the ink reservoir has been incorporated into the pen body such that when the pen runs out of ink, the entire pen, including the printhead, is replaced. However, for other hardcopy applications, such as large format plotting of engineering drawings, color posters and the like, there is a requirement for the use of much larger volumes of ink than can be contained within the replaceable pens. Therefore, various off-board ink reservoir systems have been developed recently which provide an external stationary ink supply. The external stationary ink supply may connected to the scanning cartridge or pen via a tube, or alternatively, the scanning cartridge or pen may move to the stationary ink supply and refill by "taking a gulp" from the ink supply. The external ink supply is typically known as an "off-axis," "off-board," or "off-carriage" ink supply.

The print quality produced from an inkjet device is dependent upon the reliability of its ink ejection elements. A multi-pass print mode can partially mitigate the impact of the malfunctioning ink ejection elements on the print quality. However, when more than a few ink ejection elements are malfunctioning, the multi-pass print mode can no longer solve the image quality problems caused by the malfunctioning ink ejection elements and the pen has to replaced in order to obtain satisfactory image quality.

Accordingly, what is needed is a method which corrects for malfunctioning or inoperable ink ejection elements by substituting a fully functioning ink ejection element.

SUMMARY OF THE INVENTION

The present invention provides a dynamic multi-pass print mode correction method which corrects for malfunctioning or inoperable ink ejection elements by substituting a fully functioning ink ejection element. The method comprises the steps of obtaining a printmask; identifying ink ejection elements which are malfunctioning; ascertaining potential replacement ink ejection elements from the printmask for the ejection elements which are malfunctioning; selecting replacement ink ejection elements from the potential replacement ink ejection elements; and modifying the printmask by removing the malfunctioning ink ejection elements from the printmask and replacing them with the selected replacement ink ejection elements.

DETAILED DESCRIPTION OF THE PREFERRED EMBODIMENTS

A preferred embodiment of the present invention is in the first commercial high-resolution color printer/plotter to print bi-directionally without full-height offset of the pens in the direction parallel to the printing medium advance.

Figure 1:
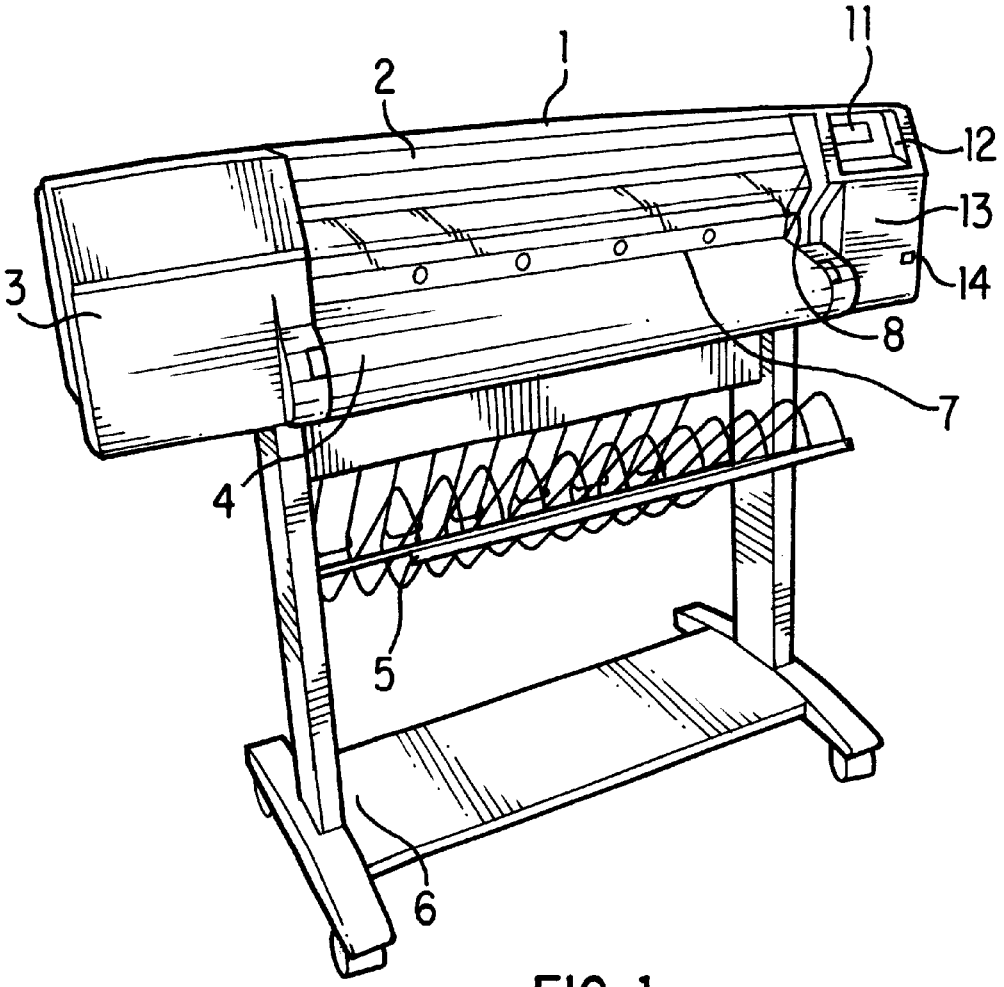
FIG. 1 is an isometric or perspective exterior view of a large-format printer-plotter which in a preferred embodiment of the present invention

As shown in FIG. 1, the printer/plotter includes a main case 1 with a window 2, and a lefthand pod 3 that encloses one end of the chassis. Within that pod are carriage support and drive mechanics and one end of the printing medium advance mechanism, as well as a pen refill station with supplemental ink cartridges. The printer/plotter also includes a printing medium roll cover 4, and a receiving bin 5 for lengths or sheets of printing medium on which images have been formed, and which have been ejected from the machine. A bottom brace and storage shelf 6 spans the legs which support the two ends of case 1. Just above the print medium cover 4 is an entry slot 7 for receipt of continuous lengths of printing medium 4. Also included are a lever 8 for control of the gripping of the print medium by the machine.

A front panel display 11 and controls 12 are mounted in the skin of the right hand pod 13. That pod encloses the right end of the carriage mechanics and of the medium advance mechanism, and also a printhead cleaning station. Near the bottom of the right hand pod for readiest access is a standby switch 14.

Figure 2:
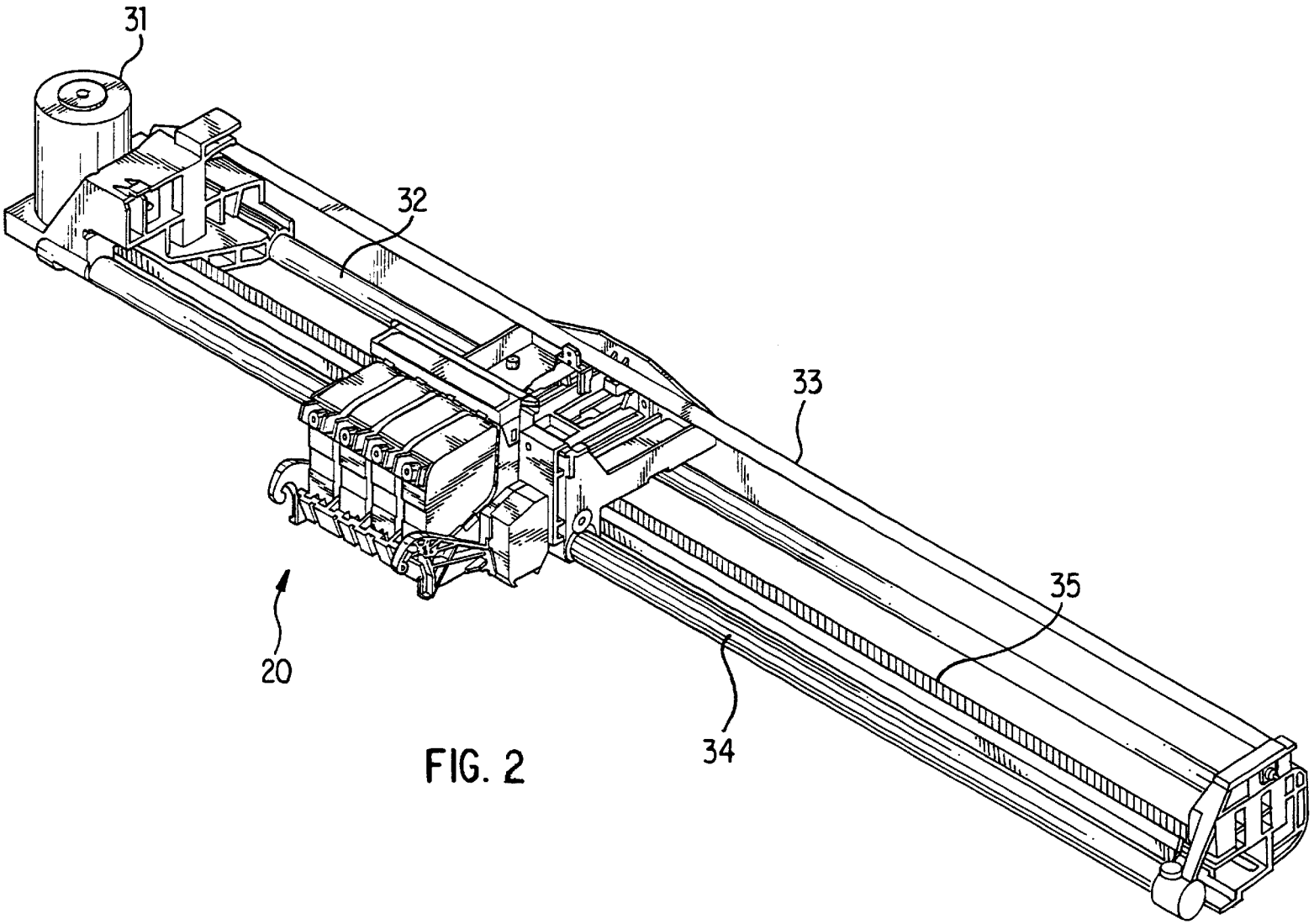
FIG. 2 is a like view of a carriage and carriage drive mechanism which is mounted within the case or cover of the large-format printer-plotter shown in FIG. 1.

As shown in FIG. 2, within the case 1 and pods 3, 13 the carriage assembly 20 is driven in reciprocation by a motor 31 along dual support and guide rails 32, 34 through the intermediary of a drive belt 35. The motor 31 is under the control of a digital electronic microprocessor (not shown).

Figure 3:
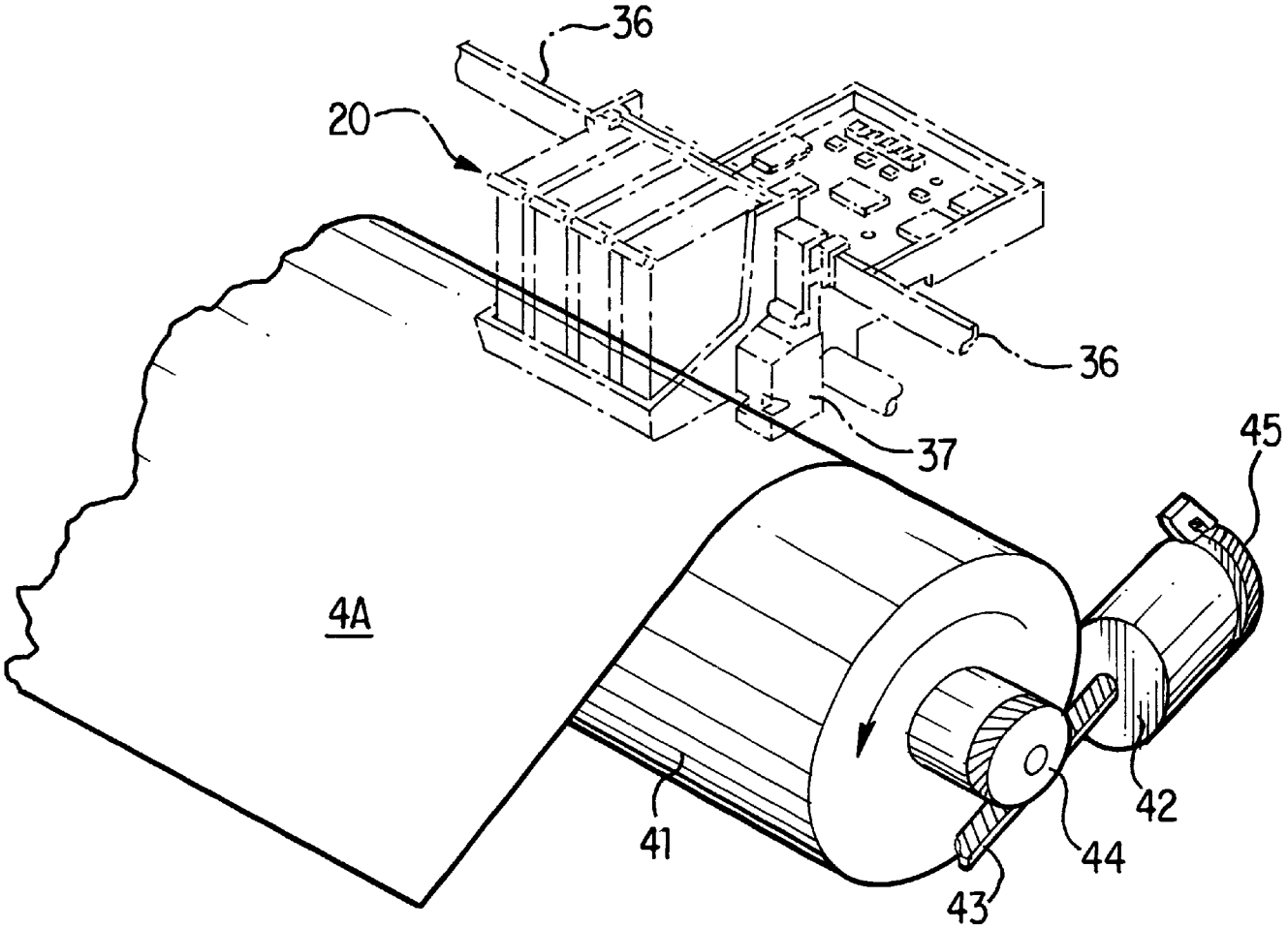
FIG. 3 is a like view of a printing medium advance mechanism which is also mounted within the case or cover of the large-format printer-plotter shown in FIG. 1, in association with the carriage as indicated in the broken line in FIG. 3.

A very finely graduated encoder strip 33 is extended taut along the scanning path of the carriage assembly 20, and read by an automatic opto-electronic sensor to provide position and speed information for the microprocessor. The code strip 33 thus enables formation of color ink drops at ultrahigh precision (as mentioned earlier, typically 24 pixels/mm) during scanning of the carriage assembly 20 in each direction, i.e., either left to right (forward) or right to left (back). A currently preferred location for the encoder strip 33 is near the rear of the carriage tray (remote from the space into which a user's hands are inserted for servicing of the pen refill cartridges). Referring to FIG. 3, immediately behind the pens 23–26 mounted in carriage 20 is another advantageous position for the strip 36. For either position, the sensor 37 is disposed with its optical beam passing through orifices or transparent portions of a scale formed in the strip.

A cylindrical platen 41, driven by a motor 42, worm 43 and worm gear 44 rotates under the carriage assembly 20 scan track to drive sheets or lengths of printing medium 4A in a medium advance direction perpendicular to the scanning. Print medium 4A is thereby drawn out of the print medium roll cover 4, passed under the pens on the carriage assembly 20 to receive ink drops for formation of a desired image, and ejected into the print medium bin 5.

Figure 4:
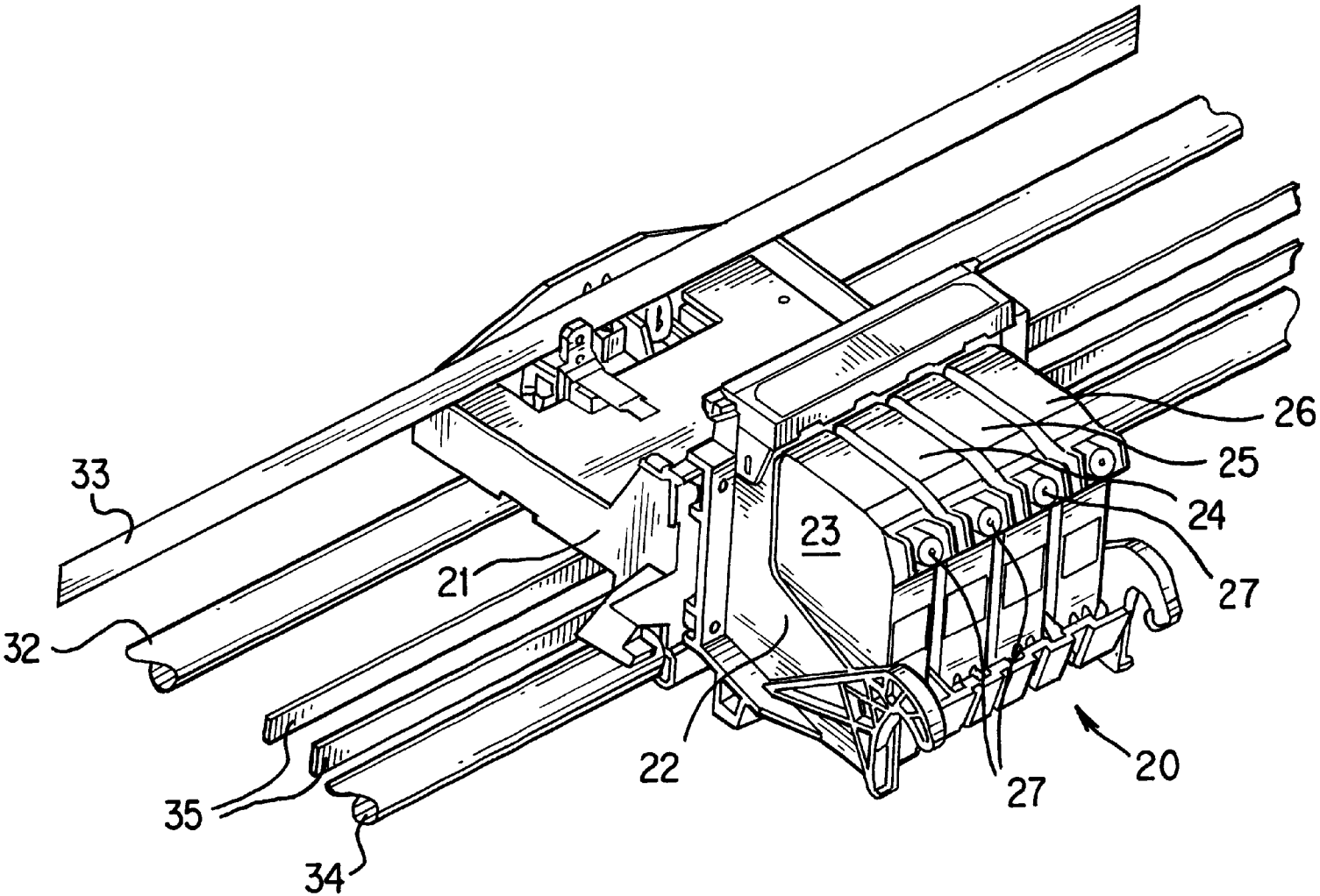
FIG. 4 is a like view, but more-detailed view of the carriage and carriage drive mechanism of FIG. 2, showing the printhead means or pens which it carries.

Referring to FIG. 4, the carriage assembly 20 includes a previously mentioned rear tray 21 carrying various electronics. It also includes bays 22 for preferably four pens 23–26 holding ink of four different colors respectively, preferably yellow in the leftmost pen 23, then cyan 24, magenta 25 and black 26. Each of these pens, particularly in a large format printer/plotter as shown, preferably includes a respective ink refill valve 27.

Figure 5:
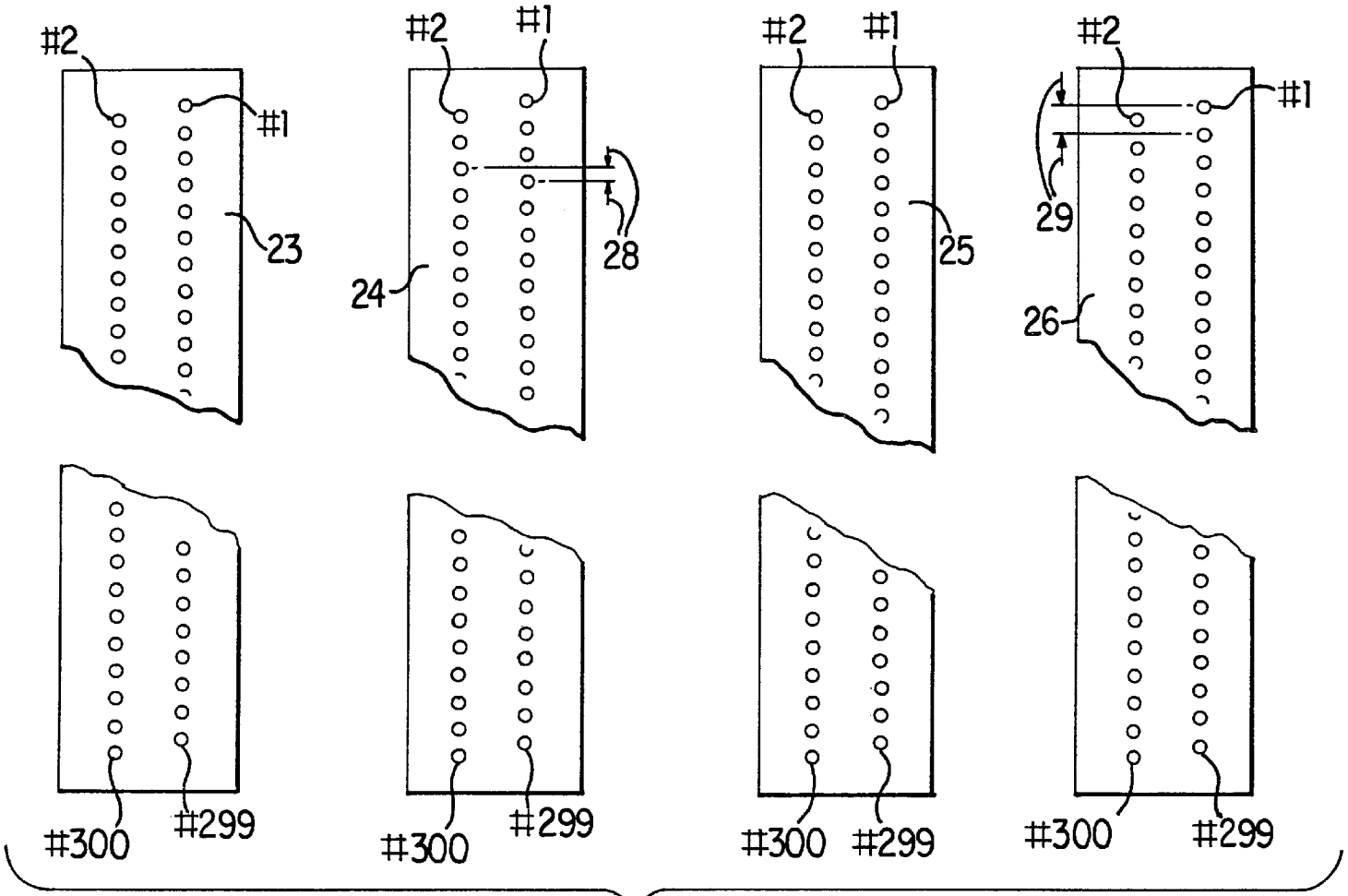
FIG. 5 is a bottom plan view of the printhead means or pens of FIG. 4 showing their nozzle arrays.

Referring to FIG. 5, the pens, unlike those in earlier mixed resolution printer systems, all are relatively long and all have nozzle spacing 29 equal to one-twelfth millimeter along each of two parallel columns of nozzles. These two columns contain respectively the odd-numbered nozzles 1 to 299, and even-numbered nozzles 2 to 300. The two columns, thus having a total of one hundred fifty nozzles each, are offset vertically by half the nozzle spacing, so that the effective pitch of each two-column nozzle array is one-twenty-fourth millimeter. The natural resolution of the nozzle array in each pen is thereby made twenty-four nozzles (yielding twenty-four pixels) per millimeter.

Figure 6:
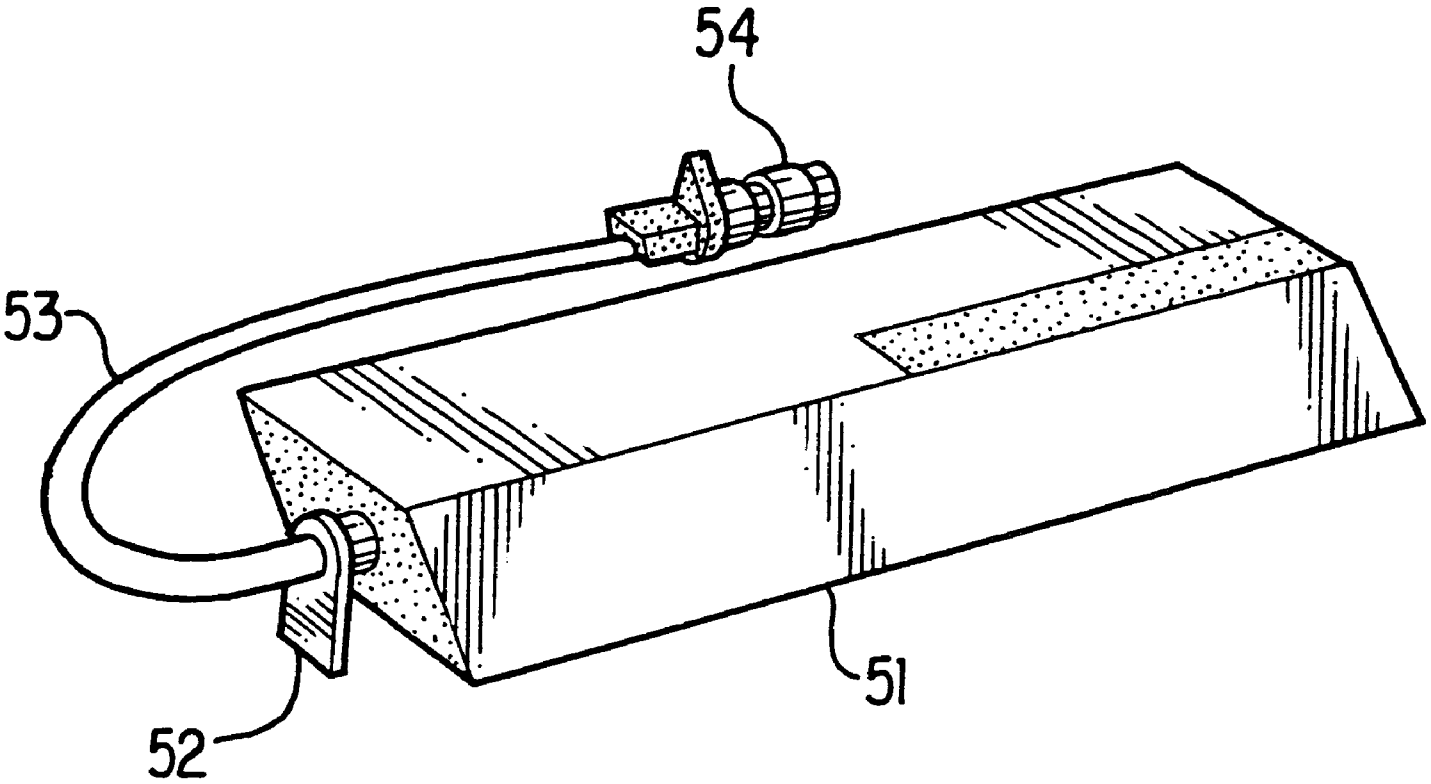
FIG. 6 is a perspective or isometric view of an ink refill cartridge for use with the FIG. 4 and 5 pens.

Referring to FIG. 6, for re-supply of ink to each pen the system includes a refill cartridge 51, with a valve 52, umbilicus 53 and connector nipple 54. The latter mates with supply tubing within the printer/plotter refill station in the lefthand pod 3. Each supply tube in turn can complete the connection to the previously mentioned refill valve 27 on a corresponding one of the pens, when the carriage is halted at the refill station. A user manually inserts each refill cartridge 51 into the refill station as needed.

Preferably black (or other monochrome) and color are treated identically as to speed and most other parameters. In one preferred embodiment the number of printhead nozzles used is always two hundred forty, out of the three hundred nozzles in the pens. This arrangement allows, inter alia, for software/firmware adjustment of the effective firing height of the pen over a range of plus or minus 30 nozzles, at 24 nozzles/mm, or ±30/24=±1¼ mm, without any mechanical motion of the pen along the print medium advance direction.

Alignment of the pens can be checked automatically, and corrected through use of the extra nozzles.

The concept of printmodes is a useful and well-known technique of laying down in each pass of the pen only a fraction of the total ink required in each section of the image, so that any areas left white in each pass are filled in by one or more later passes. This tends to control bleed, blocking and cockle by reducing the amount of liquid that is on the page at any given time.

The specific partial-inking pattern employed in each pass, and the way in which these different patterns add up to a single fully inked image, is known as a "printmode." Printmodes allow a trade-off between speed and image quality. For example, a printer's draft mode provides the user with readable text as quickly as possible. Presentation, also known as best mode, is slow but produces the highest image quality. Normal mode is a compromise between draft and presentation modes. Printmodes allow the user to choose between these trade-offs. It also allows the printer to control several factors during printing that influence image quality, including: 1) the amount of ink placed on the media per dot location, 2) the speed with which the ink is placed, and, 3) the number of passes required to complete the image. Providing different printmodes to allow placing ink drops in multiple swaths can help with hiding nozzle defects. Different printmodes are also employed depending on the media type.

One-pass mode operation is used for increased throughput on plain paper. Use of this mode on other papers will result in too large of dots on coated papers, and ink coalescence on polyester media. The one pass mode is one in which all dots to be fired on a given row of dots are placed on the medium in one swath of the print head, and then the print medium is advanced into position for the next swath.

A two-pass printmode is a print pattern wherein one-half of the dots available for a given row of available dots per swath are printed on each pass of the printhead, so two passes are needed to complete the printing for a given row. Typically, each pass prints the dots on one-half of the swath area, and the medium is advanced by one-half the distance to print the next pass as in the one pass mode. The mode is used to allow time for the ink to evaporate and the medium to dry, to prevent unacceptable cockle and ink bleeding.

Similarly, a four-pass mode is a print pattern wherein one fourth of the dots for a given row are printed on each pass of the printhead. For a polyester medium, the four pass mode is used to prevent unacceptable coalescence of the ink on the medium. Multiple pass thermal ink-jet printing is described, for example, in commonly assigned U.S. Pat. Nos. 4,963,882 and 4,965,593.

In general it is desirable to use the minimum number of passes per full swath area to complete the printing, in order to maximize the throughput. In the preferred embodiment of the preferred invention, all print modes are bidirectional. In other words, consecutive passes are printed in different directions, alternating left-to-right scene with right-to-left. A printnode particularly suited for use with the present invention is described in U.S. patent application, Ser. No. 08/810747, filed concurrent herewith, entitled "BIDIRECTIONAL COLOR PRINTMODES WITH SEMISTAGGARED SWATHS TO MINIMIZE HUE SHIFT AND OTHER ARTIFACTS" which is herein incorporated by reference.

The pattern used in printing each nozzle section is known as the "printmode mask" or "printmask", or sometimes just "mask." The term "printmode" is more general, usually encompassing a description of a mask, or several masks, used in a repeated sequence and the number of passes required to reach "full density," and also the number of drops per pixel defining what is meant by full density.

A printmask is a binary pattern that determines exactly which ink drops are printed in a given pass or, to put the same thing in another way, which passes are used to print each pixel. In a printmode of a certain number of passes, each pass should print, of all the ink drops to be printed, a fraction equal roughly to the reciprocal of that number. Thus, a printmask is used to determine in which pass each pixel will be printed. The printmask is thus used to "mix up" the nozzles used, as between passes, in such a way as to reduce undesirable visible printing artifacts.

Another important consideration with thermal inkjet printers is improper operation or malfunction of ink ejection elements due to failed resistors, clogged nozzles, or some other cause. The presence of malfunctioning of ink ejection elements cannot be visually detected and thus, the presence of malfunctioning of ink ejection elements would be manifested by bad printer output, which is wasteful since the subject matter intended to be printed would have to be printed again.

Optical drop detect circuits are utilized in ink jet printers for various purposes including testing of the operation of ink drop firing nozzles of a printhead and determination of the relative positions of the nozzle arrays of multiple printheads. Optical drop detect circuits typically include a light sensor such as a photo diode which senses the light provided by a light source such as an LED. When a drop is present in the light path between the light sensor and the light source, the output of the light sensor changes since the amount of light sensed by the light sensor is reduced by the presence of the ink drop. The output of the light sensor is typically amplified and analyzed to determine whether an ink drop passed through the light path between the light source and the light sensor. Alternatively, an optical detection system can determine the presence of a drop on the media.

An optical detection system can detect the presence of malfunctioning ink ejection elements. An optical detection system particularly suited for use with the present invention is described in U.S. patent application, Ser. No. 08/811,412, filed concurrent herewith, entitled "DETECTION OF PRINTHEAD NOZZLE FUNCTIONALITY BY OPTICAL SCANNING OF A TEST PATTERN" which is herein incorporated by reference. Other methods of drop detection are described in U.S. Pat. No. 5,434,430, entitled "DROP SIZE DETECT CIRCUIT" and U.S. Pat. No. 4,922,270, entitled "INTER PEN OFFSET DETERMINATION AND COMPENSATION IN MULTI-PEN THERMAL INK JET PEN PRINTING SYSTEMS," which are herein incorporated by reference.

The print quality produced from an inkjet device is dependent upon the reliability of its ink ejection elements. A multi-pass print mode can partially mitigate the impact of the malfunctioning ink ejection elements on the print quality. However, when more than a few ink ejection elements are malfunctioning, the multi-pass print mode can no longer solve the image quality problems caused by the malfunctioning ink ejection elements and the pen has to be replaced in order to obtain satisfactory image quality.

The present invention allows one to compensate for the "malfunctioning" ink ejection elements or nozzles by substituting for the malfunctioning nozzles with "properly functioning" nozzles. Malfunctioning nozzles can be a nozzle which is either not firing or is firing with misdirection, small drop volume or some other problem. The method is transparent to the user and does not impact printer throughput.

The optical print on media detection system, or pen health measurement system, in the printer will detect if an ink ejection element is malfunctioning. Once this is known one can define a printmask which will replace the malfunctioning ink ejection elements or nozzles by substituting them with "properly functioning" nozzles.

The print mask defines the pass and the nozzle which will be used to print each pixel location, i.e., each row number and column number on the media. This information can be combined with the pen health information to find the pixel locations which will be printed by the malfunctioning nozzle. Since the printer knows this information, it can change the printmask so that pixel location will be printed in a different pass and by a different nozzle.

The algorithm takes a printmask, and a list of malfunctioning nozzles, and replaces the malfunctioning nozzles with functioning nozzles. This can be achieved when you have multiple pass printmodes and allow functioning nozzles to print what the nozzle that is malfunctioning was supposed to print.

The method of the present invention may be used with any printmode comprising two or more passes. The method can also be used with any number of nozzles. In the following example, a four-pass printmode is utilized, but any other multiple pass printmode could be used. Also, in the following example it is assumed that the pen has 192 nozzles. Accordingly, the number of nozzles used in a given pass is 192/4=48. In TABLE I, the first column identifies the row number being printed on the media. Only rows 1 through 4 of the 48 rows are shown in detail for illustrative purposes. The second column shows a portion of the printmask for rows 1–4 and for columns 1–12, which would comprise 48 pixels on the page. Thus, the second column shows the physical locations (i.e., pixels) on the media and the pass number on which the physical locations will be printed. Columns 4–6 show which nozzle numbers are used to print a given row in the four passes. The complete printmask would show all 48 rows and the total number of columns for a full page width.

TABLE I

ORIGINAL PRINTMASK

| Row Number On the Printed Media | Pass Number in Which the First 12 Columns in the Row Are Printed | Nozzle Number Used to Print in Passes 1 Through 4 for the Identified Row | | | |
|---|---|---|---|---|---|
| | | Pass 1 | Pass 2 | Pass 3 | Pass 4 |
| Row 1 | 123412341234 | 1 | 49 | 97 | 145 |
| Row 2 | 234123412341 | 2 | 50 | 98 | 146 |
| Row 3 | 341234123412 | 3 | 51 | 99 | 147 |
| Row 4 | 412341234123 | 4 | 52 | 100 | 148 |
| * * * | * * * | * * * | * * * | * * * | * * * |
| Row 48 | * * * | 48 | 96 | 144 | 192 |

As shown above, each row of the pixels on the page is traced by four different nozzles in four different passes. For example, row 1 is traced by nozzle number 1 in pass 1, nozzle number 49 in pass 2, nozzle number 97 in pass 3 and nozzle number 145 in pass 4. Now if nozzle number 1 is malfunctioning, the pixels in row 1 can be printed by nozzle number 49 in pass 2, 97 in pass 3 or 145 in pass 4. In general for any nozzle number there are P-1 other nozzles which can print the same pixel row, where P represents the number of passes in the printmode. These three alternate nozzles will be from the following set of nozzle numbers: n+48, n+96, n+144, n−48, n−96 and n−144 depending upon the value of number n. There are several considerations which determine which of the three alternate nozzles will be best suited for the replacing the malfunctioning nozzle. They include, but are not limited to: (1) It is better to use middle nozzles than end nozzles in a pen and (2) It is better to select a replacement nozzle in such a fashion that no nozzle fires at a frequency higher than optimum pen firing frequency.

Assume that nozzle 146 is determined to be malfunctioning from the pen health measurement system. From column 6 of TABLE I it can be seen that nozzle 146 is used to print row 2 on pass number 4. It can also be seen from columns 3–5 that nozzles 2, 50, and 98 are also used to print row 2, but on passes 1, 2 and 3, respectively. Accordingly, either nozzles 2, 50, or 98 could be used to replace using nozzle 146 on pass 4 by using either nozzles 2, 50, or 98 on passes 1, 2, or 3, respectively. Likewise, the same procedure can be used for any other of the 192 nozzles which are shown to be malfunctioning from the pen health measurement system. Since, there would be three substitute nozzle choices in a four-pass printmode, the likelihood of finding a functional nozzle replacement is almost certain. If possible, it would be best to select a functioning nozzle that is not in an adjacent pass to keep the nozzle firing frequency to a minimum. Using this criteria in this example, nozzle 50 in pass 2 would be used to replace nozzle 146, rather than nozzles 98 or 2 which are in adjacent passes 3 and 1, respectively. Thus, the TABLE I printmask would be changed as shown in TABLE II to eliminate the need for printing with nozzle 146.

TABLE II

MODIFIED PRINTMASK

| Row Number On the Printed Media | Pass Number in Which the First 12 Columns in the Row Are Printed | Nozzle Number Used to Print in Passes 1 Through 4 for the Identified Row | | | |
|---|---|---|---|---|---|
| | | Pass 1 | Pass 2 | Pass 3 | Pass 4 |
| Row 1 | 123412341234 | 1 | 49 | 97 | 145 |
| Row 2 | 23**2**123**2**123**2**1 | 2 | 50 | 98 | Not Used |
| Row 3 | 341234123412 | 3 | 51 | 99 | 147 |
| Row 4 | 412341234123 | 4 | 52 | 100 | 148 |
| * * * | * * * | * * * | * * * | * * * | * * * |
| Row 48 | * * * | 48 | 96 | 144 | 192 |

From Row 2 in TABLE II it can be seen that the columns 3, 7, and 11 that were originally to be printed in pass 4 by nozzle 146 in accordance with the original printmask are now shown being printed in pass 2 as illustrated by the numeral 2's that are shown in boldface italic. Thus, the Row 2 is now printed in only three passes, i.e., passes 1, 2 and 3. These changes only relate to the portion of the printmask shown in detail above where nozzle 146 is used. Obviously, there will be other changes in the other rows and columns of the printmask where nozzle 146 is used for the rest of the page, but the methodology remains the same.

As will be apparent to one skilled in the art, the procedure described above can be used with any printmode having two or more passes. The number of potential replacement nozzles of course increases with the number of passes in the printmode, since the number of potential replacement nozzles is equal to the number of passes minus one. For example, the number of potential replacement nozzles in a two-pass printmode would be one, while for a six-pass printmode it would be five.

Figure 7:
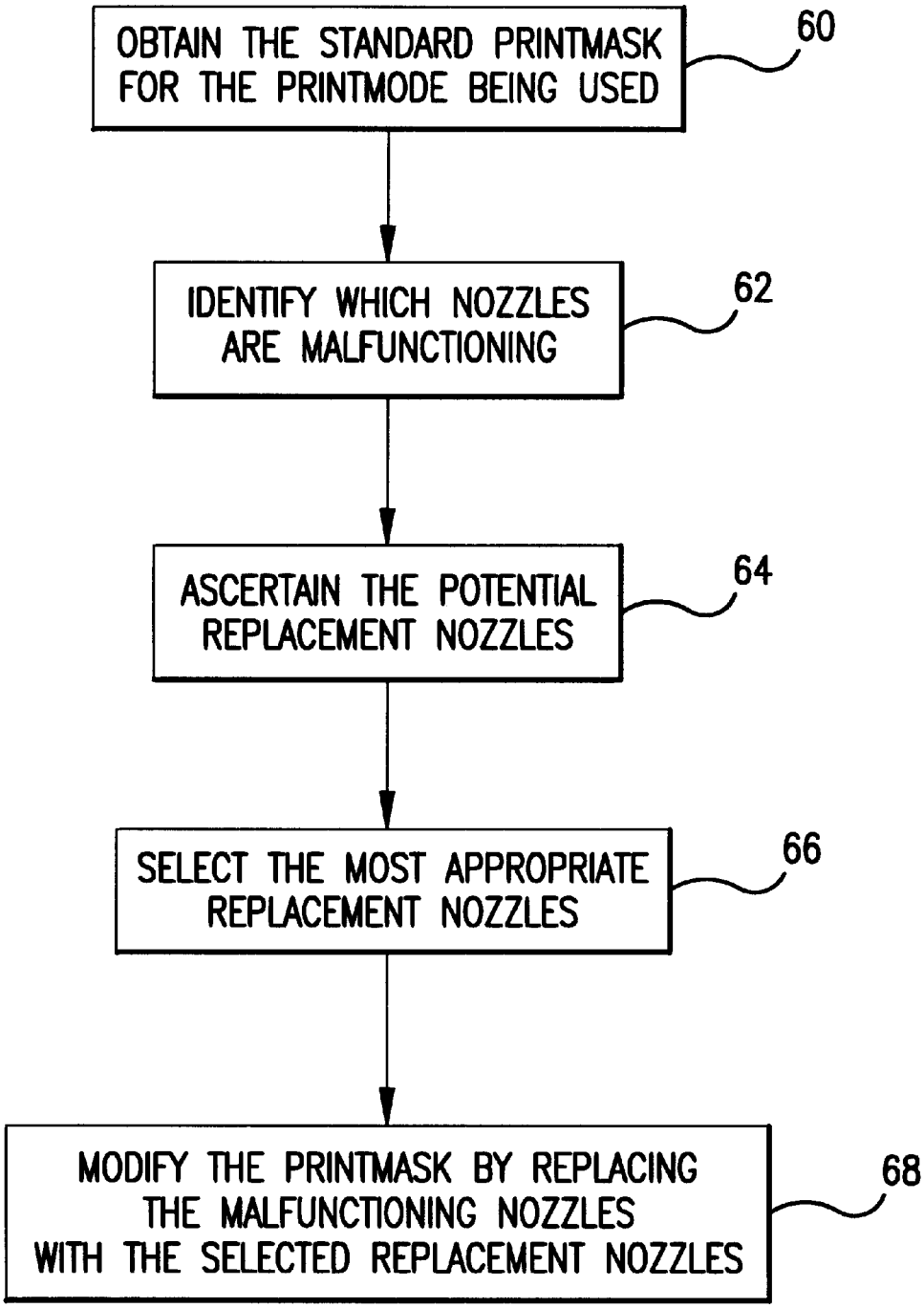
FIG. 7 is a flowchart showing the method of the present invention.

The following steps of the present invention may be performed for the entire printmask at one time or performed individually for each pass. Referring to FIG. 7, in step 60, obtain the standard printmask for the printmode being used from either the printer driver, the printer's microprocessor control system, a lookup table in the printer's memory, or any other available source. In step 62, identify which nozzles are malfunctioning from the pen health measurement system. In step 64, for each of the malfunctioning nozzles, ascertain the potential replacement nozzles from the standard printmask obtained in step 60 and the pen health measurement system. In step 66, select the most appropriate replacement nozzle from the available replacement nozzles based on appropriate criteria. In step 68, modify the printmask by removing the malfunctioning nozzles from the printmask and replacing them with the selected replacement nozzles.

If in the above procedure all of the potential replacement nozzles are also malfunctioning, the printer/plotter can give the user the choice of continuing to print using the malfunctioning nozzles or installing a new pen.

While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. A method of correcting for malfunctioning ink ejection elements in a printing system using multiple passes of ink ejection elements over a recording medium, comprising the steps of:

obtaining a standard printmask;

identifying the malfunctioning ink ejection elements;

ascertaining from the standard printmask alternative ink ejection elements for the malfunctioning ink ejection elements;

selecting replacement ink ejection elements from the alternative ink ejection elements; and modifying the standard printmask by removing the malfunctioning ink ejection elements from the standard printmask and replacing the malfunctioning ink ejection elements with the selected reeplacement ink ejection elements to create a modified printmask without modifying a swath width of the multiple passes.

2. The method of claim 1 wherein said obtaining step includes obtaining data specifying a pixel grid of rows and columns.

3. The method of claim 1 wherein said obtaining step includes obtaining data specifying a pass used to print a particular pixel location.

4. The method of claim 1 wherein said obtaining step includes obtaining data specifying an ink ejection element used to print a particular pixel location.

5. The method of claim 1 wherein said obtaining step includes obtaining the printmask from a printer driver.

6. The method of claim 1 wherein said obtaining step includes obtaining the printmask from a printer memory.

7. The method of claim 1 wherein said identifying step includes using an acoustical drop ejection detection to identify the malfunctioning ink ejection elements.

8. The method of claim 1 wherein said identifying step includes using an optical drop ejection detect to identify the malfunctioning ink ejection elements.

9. The method of claim 8 wherein the optical drop ejection detect includes passing a light beam from a light source to a light sensor through a path of ink droplets from a plurality of ink ejection chambers to the recording medium.

10. The method of claim 8 wherein the optical drop ejection detect includes passing a light beam from a light source to the recording medium which is reflected to a light sensor thereby determining if an ink droplet has been deposited on the recording medium.

11. The method of claim 1 wherein said ascertaining step includes obtaining data specifying an alternative ink ejection element and an alternative pass to print a row of pixels.

12. The method of claim 11 wherein said ascertaining step includes obtaining alternative ink ejection elements equal to a total number of passes minus one.

13. The method of claim 11 wherein said ascertaining step, includes obtaining data using a look-up table.

14. The method of claim 1 wherein said ascertaining step includes obtaining data from a printer memory.

15. The method of claim 1 wherein said ascertaining step includes obtaining data from a printer driver.

16. The method of claim 1 which includes at least three multi-passes over a given pixel row, and wherein said selecting step includes selecting a replacement ink ejection element which would be used in a non-adjacent pass.

17. The method of claim 1 wherein said selecting step includes selecting a replacement ink ejection element which is located in the middle an array of ink ejection elements.

18. The method of claim 1 wherein said steps are performed for the entire printmask at one time.

19. The method of claim 1 wherein said steps are performed for a portion of the printmask that is used individually for each pass.

20. The method of claim 1 further including the step of ejecting ink drops onto the recording medium in multiple passes over the recording medium in accordance with the modified printmask.

21. A method of printing using multiple scanning passes of ink ejection elements over a recording medium and correcting for malfunctioning ink ejection elements, comprising the steps of:

obtaining a standard printmask defining a pixel grid of rows and columns and the ink ejection element which ejects on a particular row and column of the pixel grid in a particular pass;

identifying the malfunctioning ink ejection elements;

ascertaining alternative ink ejection elements for the ejection elements which are malfunctioning;

selecting replacement ink ejection elements from the alternative ink ejection elements;

modifying the standard printmask by removing the malfunctioning ink ejection elements from the standard printmask and replacing the malfunctioning ink ejection elements with the selected replacement ink ejection elements to create a modified printmask; and ejecting ink drops onto the recording medium in multiple scanning passes over the recording medium in accordance with the modified printmask without increasing a total number of the multiple scanning passes.

* * * * *